United States Patent [19]

Gorondy

[11] 4,420,307

[45] Dec. 13, 1983

[54] PRINTING PROCESS

[75] Inventor: Emery J. Gorondy, Chadds Ford, Pa.

[73] Assignee: E. I. Du Pont de Nemours & Co., Wilmington, Del.

[21] Appl. No.: 392,789

[22] Filed: Jun. 28, 1982

[51] Int. Cl.[3] ..... D06P 5/20

[52] U.S. Cl. ..... 8/444; 8/471; 8/922

[58] Field of Search ..... 8/471, 444

[56] References Cited

U.S. PATENT DOCUMENTS

| | | | |
|---|---|---|---|
| 3,860,388 | 1/1975 | Haigh | 8/2.5 |
| 3,915,628 | 10/1975 | Bossard et al. | 8/2.5 |
| 4,099,186 | 7/1978 | Edwards et al. | 346/74.1 |
| 4,117,498 | 9/1978 | Edwards et al. | 346/74.1 |
| 4,124,384 | 11/1978 | Centa | 96/14 |
| 4,145,300 | 3/1979 | Hendriks | 252/62.1 |
| 4,172,418 | 10/1979 | Durand | 8/471 |
| 4,246,331 | 1/1981 | Mehl et al. | 8/471 |
| 4,251,611 | 2/1981 | Mehl et al. | 8/471 |

*Primary Examiner*—A. Lionel Clingman

[57] ABSTRACT

A process is described for dyeing a disperse dyeable material such as a textile or film, comprising the steps of: forming a latent magnetic image in a magnetic imaging member comprising a ferromagnetic material on an electrically conductive support; developing the magnetic image by applying thereto a ferromagnetic toner comprising a ferromagnetic component, a dye compnent containing a dye which is substantially sublimable at from 160° to 215° C., and a resin, which substantially encapsulates the ferromagnetic component and the dye component; transferring the developed image to a paper sheet, applying a thermally stable sublimable-dye-permeable polymeric material to the side of the paper sheet bearing the toner image material into contact with a textile material to be dyed; and heating the textile material and paper sheet to thereby transfer the dye image from the paper sheet through the polymeric material to form a dye image in the textile material.

5 Claims, 2 Drawing Figures

PRINTING PROCESS

BACKGROUND OF THE INVENTION

1. Field of the Invention

This invention relates to a process for printing textile material. More particularly, the process relates to forming a dye image of a sublimable dye by magnetic printing, transferring the dye image to a paper web, applying a resin layer over the dye image and transferring the dye image to a textile material by sublimation thereof.

2. Description of the Prior Art

In the conventional printing of textile materials, normally the textile material or fabric is glued to a printing blanket that transports it under the printing rolls or screens. After all colors have been applied, the fabric is oven dried, then the dyes are fixed, e.g., by hot air or high-pressure high-temperature steam. The textiles are then scoured and dried. In structurally unstable fabrics, such as polyester double knit materials, waste due to inadequate registration of the different colors may amount to 20–30%, which is very unsatisfactory.

Magnetic printing processes, particularly useful in overcoming the problem in electrostatic copying processes of unsatisfactory copying of large dark areas, are known in the art. Such processes are described, for instance, in U.S. Pat. Nos. 4,099,186 and 4,117,498. The particular processes described in U.S. Pat. Nos. 4,099,186 and 4,117,498 relate to processes wherein a dye and/or other chemical treating agent contained in a ferromagnetic toner is transferred directly to a substrate, e.g., such as a textile material, or is transferred to a first substrate, such as paper, for subsequent transfer to a final substrate. The difference in the processes of U.S. Pat. Nos. 4,099,186 and 4,117,498 is that the former includes a step of subjecting the ferromagnetic materials to the action of a charge dissipating means.

U.S. Pat. No. 3,860,388 describes a method of dye absorption into the surfaces of plastics by placing a polyethylene film between a dye transfer paper and a sheet of plastic and applying pressure and heat thereto. The dyes sublime through the polyethylene film to the plastic film to be dyed.

U.S. Pat. No. 3,915,628 relates to a continuous dry transfer-printing process for textile webs wherein a continuous inert carrier, advantageously stainless steel, aluminum or paper, is applied to the surface of the web, which is then contacted with the material to which the dye is to be transferred, followed by heating and sublimation of the dye.

SUMMARY OF THE INVENTION

According to the process of the invention, a magnetic dye image is formed on a magnetic imaging member. The thus formed magnetic dye image is transferred first to the surface of a paper web, the paper web is then coated with a thermally stable disperse-dye-permeable resin or laminated to a film of a thermally stable disperse-dye-permeable resin on the side bearing the dye image, and the dye is subsequently sublimed through the coating or film to a disperse dyeable material such as a film or textile, hereinafter referred to as a "textile material" that has been brought into contact with such coating or film, to thereby form a dye image in the textile material.

More specifically, the process of the invention comprises the steps of: forming a magnetic image on a magnetic imaging member comprising a ferromagnetic material imposed on an electrically conductive support; developing the magnetic image by applying a ferromagnetic toner comprising a ferromagnetic component, a dye component containing a dye that is subtantially sublimable at from about 160° to 215° C., and a resin, which substantially encapsulates the ferromagnetic component and the dye component; transferring the developed image to a web of paper, laminating of a thermally stable, disperse-dye-permeable polymeric film to the surface of the paper bearing the image or coating the surface of the paper bearing the image with a thermally stable disperse-dye-permeable polymer; bringing the polymeric film or coating into contact with a textile material to be dyed; heating the textile material and the image bearing paper to cause substantial sublimation of the dye component of the toner, thereby transferring said dye image from the paper through the polymeric film or coating to form a dye image in the textile material.

DETAILED DESCRIPTION OF THE INVENTION

Figure 1:
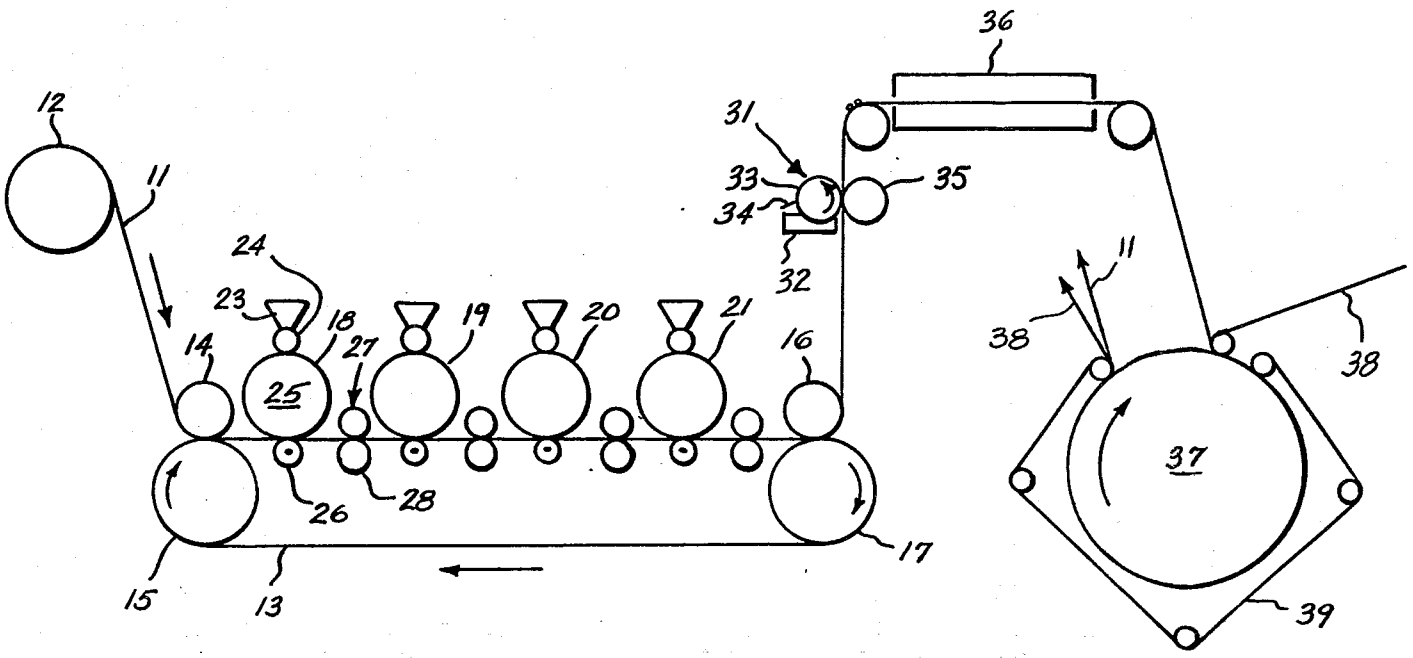
FIG. 1 is an illustrative diagram of an apparatus useful for practicing the process of the invention.

The formation of a magnetic image on a ferromagnetic material imposed on an electrically conductive support can be accomplished by techniques known in the art of magnetic recording. Examples of such techniques are described in U.S. Pat. Nos. 4,099,186 and 4,117,498, the disclosures of which are incorporated herein by reference.

In the invention the magnetic image is developed by applying a ferromagnetic toner comprising a ferromagnetic component, a dye component which is substantially sublimable at from 160° to 215° C., and a resin, which substantially encapsulates the ferromagnetic component and the dye component.

The ferromagnetic component of the ferromagnetic toner can consist of hard magnetic particles, soft magnetic particles, or a binary mixture of hard and soft magnetic particles. Such particles are described in U.S. Pat. Nos. 4,099,186 and 4,117,498.

The dye component used in the ferromagnetic toner should be sublimable at a temperature from 160° to 215° C. Dyes falling into this category include low-energy and medium-energy dyes, with medium-energy dyes being preferred. Examples of such dyes include . . .

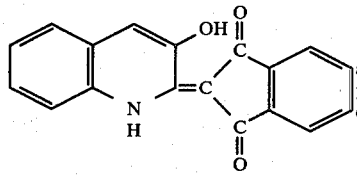

a medium energy yellow disperse dye,

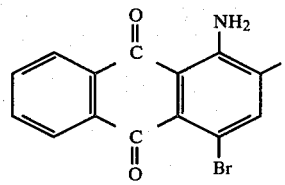

Br a low to medium energy red disperse dye,

-continued

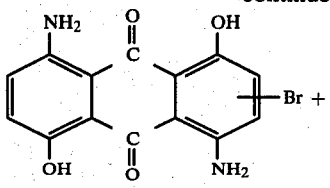

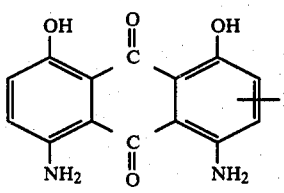

Br a medium energy blue disperse dye, and

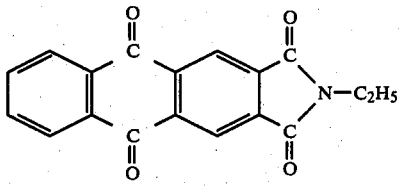

$N-C_2H_5$ a greenish blue disperse dye.

The concentration of the dye component in the ferromagnetic toner can vary over a range of from about 1.0% to about 10.0% by weight, based on the total weight of the toner. In a preferred embodiment, the concentration of dye component is between 3.0% and 9.0% by weight.

The resin which encapsulates the ferromagnetic component and the dye component of the ferromagnetic toner may be any known, readily fusable, natural, modified natural, or synthetic resin or polymer. Examples of such resins are described in U.S. Pat. Nos. 4,099,186 and 4,117,498, as well as the specific encapsulation techniques therefor.

The relative amounts of resinous material and ferromagnetic component in the toner are determined by the desired adhesive and magnetic properties of the toner particle. Generally, a ratio of resinous material to ferromagnetic material of 0.11:1 to 3.3:1 is useful, with the range of 0.40:1 to 1.0:1 being preferred.

Other components may optionally be added to the ferromagnetic toner, such as those described in U.S. Pat. Nos. 4,099,186 and 4,117,498.

In the process of the invention the developed magnetic image is transferred to a paper web, and covered with thermally stable, disperse-dye-permeable polymeric film or coating. In one preferred embodiment, the thermally stable, disperse-dye-permeable polymeric film is a polyester film, e.g., Mylar®. Other polymeric films that may be used in the process of the invention include polyamides, polyvinyl acetate and cellulose acetate.

Textile materials that can be dyed according to the process of the invention include polymers that are "disperse-dyeable", that is, materials capable of forming a solid solution of the dye in the textile material. Such textile materials include polyesters and nylon, with polyesters, such as poly(ethylene terephthalate), being particularly preferred.

An apparatus for carrying out the process of the invention comprises a means for forming a magnetic image on a ferromagnetic material, a means for developing the magnetic image using a ferromagnetic toner, a means for transferring the developed magnetic image from the ferromagnetic material to a paper surface, covering the image with a thermally stable, disperse-dye-permeable polymeric material, means for bringing said polymeric material into contact with a textile material to be dyed; and a means for heating the textile material and the polymeric film to cause substantial sublimation of the dye component, thereby transferring said dye image from the first surface of the polymeric film through the polymeric film to form a dye image on the textile material.

A particular apparatus as described above for carrying out the process of the invention is illustrated in FIG. 1. In FIG. 1, a sheet of paper 11 is unrolled from a roller 12 and transported to a continuous support belt 13 and by means of rollers 14, 15, 16 and 17 is transported through a series of magnetic printers 18, 19, 20 and 21 for printing different color images on the paper. Each of the magnetic printers comprises a toner box 23, a magnetic decorator roll 24, a print roll 25 on which the image is formed for transfer to the paper, and a DC corona or voltage biasing roll 26. After passing the magnetic printers and receiving the printed image transferred from the magnetic printers 18, 19, 20 and 21, the continuous belt and the paper are passed through a hot roll fuser 27, 28.

After printing, a disperse-dye-permeable resin is applied to the surface of the paper 11 containing the developed magnetic image at disperse-dye-permeable resin applicator station 31 comprising reservoir 32, applicator roller 33, doctor blade 34 and backup roll 35. Subsequently paper sheet 11 is fed through drier 36. At this point the paper sheet 11 with the disperse-dye-permeable resin covered developed magnetic image may be taken up on a roll and then fed through the remainder of the process as hereinafter described. Then the paper sheet 11 is fed between a heated rotating cylinder 37 together with a textile material 38 and a continuous pressure belt 39 arranged so as to maintain the paper sheet 11 in contact with the textile material 38 during passage around the heated rotating cylinder 37. During passage around the heated rotating cylinder 37 the sublimable dye present in the developed image is sublimed and permeates through the disperse-dye-permeable resin to thereby form a dye image on the textile material corresponding to the dye image printed on the paper sheet 11.

In a preferred embodiment, the process of the invention further comprises, after transferring the developed magnetic image to the paper sheet 11, contacting a thermally stable, disperse-dye-permeable polymeric film in contact with the image bearing surface of the paper sheet 11, and bringing a textile material into contact with polymeric film. Then the paper sheet 11 laminated to the polymeric film and the textile material is heated at a relatively high temperature to cause substantial sublimation of the dye in the dye component of the developed magnetic image, to thereby transfer the dye through the permeable polymeric film to form a dye image in the textile material.

Figure 2:
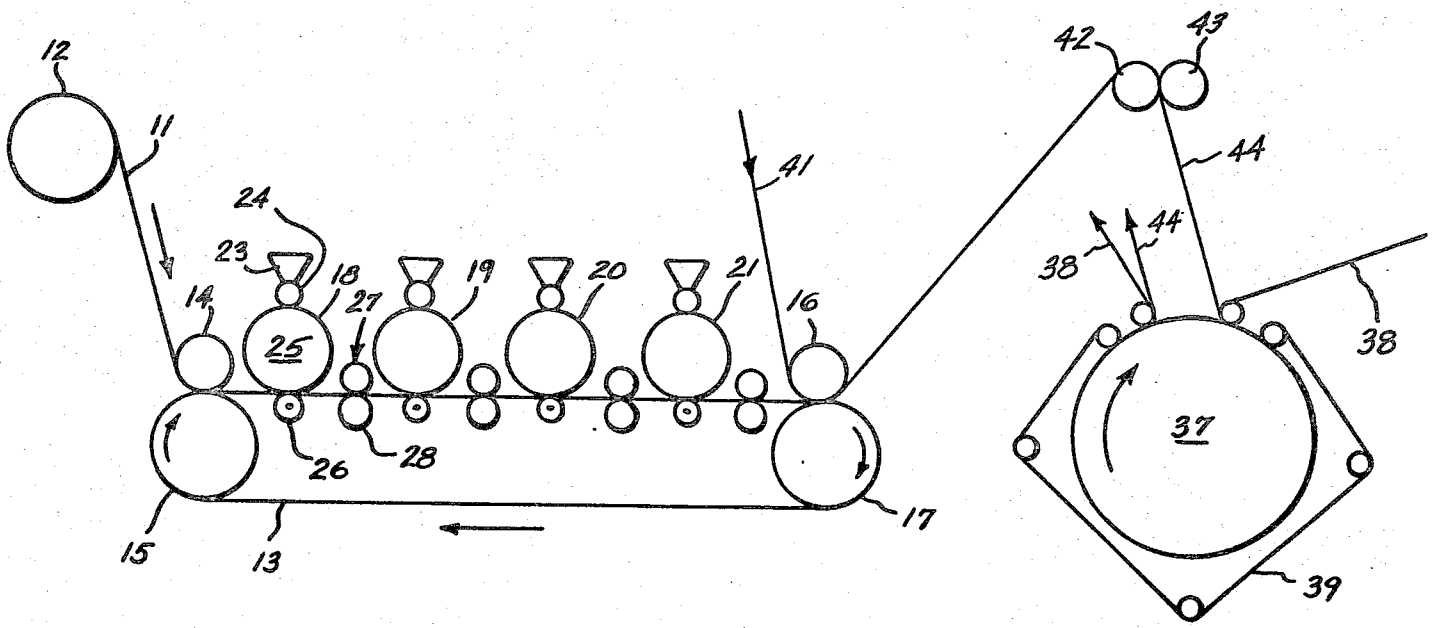
FIG. 2 is an alternative apparatus for practicing a preferred embodiment of the process of the invention.

An apparatus for carrying out the preferred embodiment of the process of the invention is illustrated in FIG. 2. The apparatus of FIG. 2 is similar to the apparatus described above for FIG. 1, up to where paper sheet 11 approaches roller 16. On reaching roller 16, a thermally stable, disperse-dye-permeable polymeric film 41 is contacted, between rollers 16 and 17, with the surface of paper sheet 11 on which the developed magnetic image is formed to form a laminate 44. At this point the laminate 44, comprising paper sheet 11 with the developed magnetic image and covering film 41 may be taken up on a roll and then fed through the remainder of the process as hereinafter described. Then the laminate containing the developed magnetic image is fed between rollers 42 and 43 and then between heated rotating cylinder 37 and a continuous pressure belt 39, together with textile material 38, which is fed between the laminate 44 and the heated rotating cylinder. During passage around the heated rotating cylinder 37, the sublimable dye present in the developed magnetic image is sublimed and permeates through the polymeric film to thereby form a dye image on the textile material corresponding to the dye image printed on the paper sheet 11.

DESCRIPTION OF THE PREFERRED EMBODIMENTS

Example 1

A yellow toner mix is prepared by mixing 5.0 wt % of

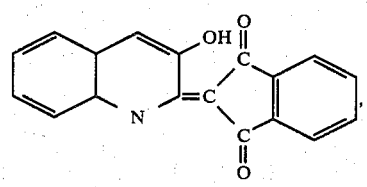

40.0 wt % Carboset XL 11, a terpolymer of methyl methacrylate, ethyl acrylate and acrylic acid having a glass transition temperature of 55° C. and an acid No. of 74 mg KOH/g, 1.5 wt % Reax 85 A, lignosulfonate dispersing agent, and 53.5 wt % of Magnetic Oxide No. 7029, $Fe_3O_4$ type ferroferric oxide.

A red toner mix is prepared by mixing 7.0 wt % of

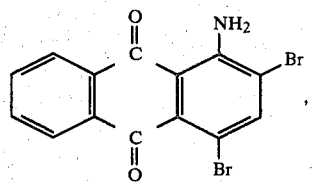

37.61 wt % carboset XL 11, 1.89 wt % Reax 85 A, and 53.50 wt % Magnetic Oxide No. 7029.

A blue toner mix is prepared by mixing 7.0 wt %

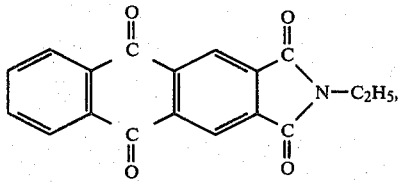

38.1 wt % Carboset, 1.4 wt % Reax 85 A and 53.5 wt % Magnetic Oxide No. 7029.

A black toner mix is prepared by mixing 3.00 wt % of the above yellow dye, 4.50 wt % of the above red dye, 4.00 wt % of the above blue dye, 36.95 wt % of Carboset XL 11, 1.55 wt % Reax 85 A, and 50.00 wt % Magnetic Oxide No. 7029.

The toner mixes are converted into toner by spray drying an aqueous dispersion thereof.

Each of the magnetic imaging members are formed of a 350 μ inches (8.9 μ meters) thick layer of acicular chromium dioxide in a binder on an electrically grounded silver coated rubber roll which is 12 inches (0.3 meter) wide. The magnetic imaging member is magnetically structured to 460 pole reversals/inch (18 pole reversals/mm) or 230 cycles/inch (9 cycles/mm) or 55 microns per pole reversal by recording a square wave with a magnetic write head at 35 mm Amps and 6 to 8 Volts. A film positive of the individual colors to be printed is placed in contact with the magnetically structured roll and stepwise uniformly illuminated by a Xenon flash at 3.3 KV with a 15° turn per flash, passing through the film positive. The dark areas of the film positive, corresponding to the areas to be printed, absorb the energy of the Xenon flash; whereas the clear areas transmit the light and heat the acicular chromium dioxide beyond its Curie point of about 116° C. thereby demagnetizing the exposed magnetized lines of acicular chromium dioxide. The thusly magnetized rolls are then registered with each other in the apparatus depicted in FIG. 1.

The four toners are individually fed from a slot in the hoppers to decorate the latent magnetic images in each of the magnetic imaging members by a decorator. The decorator comprises a rotating magnetic cylinder inside a non-magnetic sleeve. As the magnetic imaging member rotates after being decorated with toner it first passes an AC corona which serves to neutralize any electrostatic charges which may be adhering toner to the magnetic imaging member. Then a vacuum knive removes stray toner from the non-image areas. The toner is then negatively charged with a DC corona. The toner is then transferred to paper which is transported by a polytetrafluoroethylene coated woven aramide fiber belt. A negatively charged voltage biasing roll on the backside of the belt is used to effect transfer of the toner from the magnetic imaging member to the paper sheet. After toner transfer, the imaging member passes in this order, an AC corona, a brush and a vacuum knife to remove any remaining toner, prior to returning to the decorator. This is repeated at each of the remaining printing stations. The toner particles are then coalesced together with a pair of heated rolls which heat the toner to about 90° C. The paper sheet with the toner image is then fed, along with a 0.5 mil (0.013 m) thick poly(ethylene terephthalate) film, between an offset roll maintained at 110° C. and an unheated drive roll to form a laminate containing the image between the film and the paper.

The laminate is fed, together with a textile fabric on the film side, around a drum fitted with internal hot oil heater and an endless pressure belt of Teflon®. The surface of the drum is maintained at 210° C. The first pass around the drum utilizes a residence time of 30 seconds. After passing around the drum the textile fabric and the laminate are separately taken up on rolls. The process is repeated using the laminate a second time using a residence time on the drum of 45 seconds and a third time with a residence time on the drum of 60 seconds. The three textile fabrics are all dyed to nearly the same degree and depth of shade. The fabric used is a woven 24 gauge 100% poly(ethylene terephthalate) weighing 5.7 oz/yd$^2$ (0.19 Kg/m$^2$).

Example 2

Example 1 is repeated except a coating of a solution of ethyl cellulose in water is applied to the image bearing side of the paper sheet. The dye image is then repetitively sublimed and transferred to the three textiles as in Example 1.

I claim:

1. A process for dyeing a disperse dyeable textile material comprising the steps of:

forming a latent magnetic image in a magnetic imaging member comprising a ferromagnetic material imposed on an electrically conductive support;

developing the latent magnetic image by applying thereto a ferromagnetic toner comprising a ferromagnetic component, a dye component containing a dye that is substantially sublimable at from 160° to 215° C., and a resin which substantially encapsulates the ferromagnetic component and the dye component, transferring the developed image from the magnetic imaging member to a surface of a paper sheet, applying a layer of a sublimable-dye-permeable polymeric material over the image to the paper sheet, bringing said polymeric material into contact with a disperse dyeable textile material to be dyed, heating the disperse dyeable textile material and the polymeric film and paper sheet to cause substantial sublimation of the dye component, thereby transferring said dye image from the paper through the polymeric material to form a dye image on the disperse dyeable textile material.

2. A process as in claim 1 wherein the ferromagnetic material on the magnetic imaging member is subjected to the action of a charge dissipating means and a means to remove toner from non-image areas of the magnetic imaging member prior to transfer of the magnetic image to paper.

3. A process as in claim 2 wherein the polymeric material comprises a polyester film.

4. A process as in claim 3 wherein the polymeric film is between about 0.006 mm and 0.04 mm thick.

5. A process as in claim 4 wherein the disperse dyeable textile material and the polymeric film are brought into contact between a heated rotating drum and a continuous pressure belt in order to transfer the dye to the disperse dyeable textile material.

* * * * *